US011802366B2

(12) United States Patent
Bickerton

(10) Patent No.: US 11,802,366 B2
(45) Date of Patent: Oct. 31, 2023

(54) DRYING RACK

(71) Applicant: Brett D. Bickerton, Nanoose Bay (CA)

(72) Inventor: Brett D. Bickerton, Nanoose Bay (CA)

( * ) Notice: Subject to any disclaimer, the term of this patent is extended or adjusted under 35 U.S.C. 154(b) by 0 days.

(21) Appl. No.: 17/700,028

(22) Filed: Mar. 21, 2022

(65) Prior Publication Data

US 2022/0298715 A1 Sep. 22, 2022

(51) Int. Cl.

| | |
|---|---|
| ***D06F 57/08*** | (2006.01) |
| ***A47B 47/00*** | (2006.01) |
| ***A47F 5/10*** | (2006.01) |
| ***A47F 7/08*** | (2006.01) |
| ***A47L 23/20*** | (2006.01) |

(52) U.S. Cl.

CPC ..... *D06F 57/08* (2013.01); *A47B 47/00* (2013.01); *A47F 5/10* (2013.01); *A47F 7/08* (2013.01); *A47L 23/20* (2013.01)

(58) Field of Classification Search

CPC ..... A47B 46/00; A47B 45/00; A47B 47/00; A47B 47/045; A47B 61/04; A47B 81/04; A47B 2003/006; A47B 3/06; A47B 5/02; A47B 2097/007; A47F 5/10; A47F 7/08; A47F 7/0021; A47F 7/0028; A47G 25/005; A47L 23/20

USPC ..... 211/37, 2, 85.3, 85.5, 44, 33, 38, 85.15, 211/12, 41.6, 34, 43, 42; 248/461, 151

See application file for complete search history.

(56) References Cited

U.S. PATENT DOCUMENTS

| | | | | | |
|---|---|---|---|---|---|
| 19,772 | A * | 3/1858 | Hamilton | A47G 25/0664 | 211/171 |
| 1,818,761 | A * | 8/1931 | Sendler | D06F 57/12 | 312/271 |
| 2,107,306 | A * | 2/1938 | Pollinger | A47F 7/08 | 211/38 |
| 2,472,028 | A * | 5/1949 | Son | A61L 2/26 | 422/310 |
| 2,483,051 | A * | 9/1949 | Holt | D06F 57/12 | 211/104 |
| 2,684,765 | A * | 7/1954 | Lowenstein, Jr. | A47B 65/10 | 211/43 |
| 3,146,815 | A * | 9/1964 | Cirese | A47J 47/005 | 269/54.5 |
| 3,589,522 | A | 6/1971 | Chiodo | | |
| 3,999,734 | A * | 12/1976 | Gibson | A47F 7/142 | 211/2 |
| D243,313 | S | 2/1977 | Varnado | | |
| 4,031,663 | A * | 6/1977 | Brunk | A01G 9/02 | 47/72 |

(Continued)

*Primary Examiner* — Jennifer E. Novosad

(74) *Attorney, Agent, or Firm* — Michael D. Eisenberg

(57) ABSTRACT

A drying rack includes a base slab and elongated members having a first end and a second end. The second end is bifurcated with a first branch and a second branch. The elongated members have a stored position, with a second end of each of the elongated members inserted into a slot in the base slab with the first branch engaging a first face of the base slab, the second branch engaging a second face of the base slab and the first end of each elongated member maintained in the slot by friction. The elongated members have an operative position, with the elongated members arranged in an upright orientation relative to first face of the base slab. When the elongated members are inserted into openings in the base slab, the bifurcated second end is too large to pass through the openings.

5 Claims, 6 Drawing Sheets

(56) References Cited

U.S. PATENT DOCUMENTS 4,136,464 A 1/1979 Hay
4,289,243 A * 9/1981 Arbuzoff ..... A47L 23/20 211/100
4,306,661 A * 12/1981 Allsop ..... A47F 7/08 248/222.51
4,592,471 A * 6/1986 Bross ..... A47J 47/16 211/184
4,697,357 A * 10/1987 Van Vliet ..... D06F 57/00 34/239
D310,742 S 9/1990 Johnson
D322,344 S 12/1991 Winkler
5,287,636 A * 2/1994 Lafleur ..... F26B 21/006 34/239
5,492,237 A * 2/1996 Chang ..... A47L 19/04 211/202
5,520,316 A * 5/1996 Chen ..... B60R 7/02 224/567
D383,274 S 9/1997 Wilson
5,778,556 A * 7/1998 Ohsugi ..... A47G 25/005 34/106
5,815,877 A * 10/1998 Heneveld ..... A46B 7/023 15/201
5,884,778 A * 3/1999 Freiheit ..... A47F 7/0042 211/195
D412,231 S 7/1999 Williams et al.
6,014,942 A * 1/2000 Perka ..... G09F 17/00 116/319
6,073,783 A * 6/2000 Allman ..... D06F 59/02 211/85.3
6,158,578 A * 12/2000 Greiner ..... A47F 5/10 211/85.2
6,193,082 B1 * 2/2001 Bartle ..... A63C 17/00 D6/552
6,234,442 B1 * 5/2001 Huang ..... A47B 97/08 211/195
6,443,316 B1 * 9/2002 Mao ..... A47L 19/04 211/74
6,675,493 B1 * 1/2004 Martin ..... F26B 25/18 34/103
6,702,129 B1 * 3/2004 Harris ..... A47G 25/0664 211/172
7,165,689 B2 * 1/2007 McDaniel ..... A47F 7/24 211/116
7,344,036 B2 * 3/2008 Jerstroem ..... A47L 19/04 211/41.6
7,448,587 B2 * 11/2008 Han ..... G06F 1/181 361/740
8,096,430 B2 * 1/2012 Lim ..... A47B 47/00 211/41.6
RE43,349 E * 5/2012 Dunn ..... A47L 19/04 211/41.6
D687,203 S 7/2013 Long et al.
8,960,452 B2 * 2/2015 Rhodes, II ..... A47L 19/04 211/41.6
9,016,642 B1 * 4/2015 Ay ..... B60R 7/10 248/205.1
10,034,544 B2 * 7/2018 Berger ..... A47B 81/00
10,118,678 B2 * 11/2018 Dias ..... B63B 32/83
10,321,758 B2 * 6/2019 Martinage ..... A47B 43/00
2002/0027114 A1 * 3/2002 Krusell ..... A47B 81/00 211/186
2009/0107939 A1 * 4/2009 Liao ..... A47F 5/10 211/134
2012/0024808 A1 * 2/2012 Jackson ..... D06F 57/04 211/85.7
2015/0351534 A1 * 12/2015 Rege ..... A47G 25/12 211/36
2016/0061354 A1 * 3/2016 Abby ..... H04Q 1/062 211/85.5
2019/0105550 A1 * 4/2019 Teasdale ..... A42B 3/006
2019/0298148 A1 * 10/2019 Singh ..... A47L 19/04
2022/0298715 A1 * 9/2022 Bickerton ..... D06F 57/08

* cited by examiner

DRYING RACK

FIELD

There is a described a drying rack that can readily be assembled and disassembled for storage or transport.

BACKGROUND

There is a well-known type of drying rack that consists of a base with a plurality of upstanding posts. Items to be dried, such as mitts, gloves, socks, and boots, are draped in an inverted position on the posts. There have been a number of patents filed on various versions of this style of drying rack. For example, U.S. Pat. No. 3,589,522 (Chiodo) tided "Boot Rack"; U.S. design patent Des243,313 (Varnado) titled "Glove Drainer and Drier"; and U.S. design patent Des322,344 (Winkler) titled "Glove Drying Rack".

A problem with these type of drying racks is that they are bulky and require room to store and are not suitable to be carried by persons involved in outdoor activities.

SUMMARY

There is provided a drying rack which includes elongated members and a base slab. There are at least three of the elongated members. Each of the elongated members has a first end and a second end. The second end is bifurcated with a first branch and a second branch. The base slab has a first face, a second face and a series of openings that extend through the base slab between the first face and the second face. The series of openings include a slot for each of the elongated members. The elongated members have a stored position, with the second end of each of the elongated members inserted into the slot with the first branch engaging the first face of the base slab, the second branch engaging the second face of the base slab and the first end of each elongated member maintained in the slot by friction. The elongated members have an operative position, with the elongated members arranged in an upright orientation relative to first face of the base slab. This is accomplished by inserting the first end of each of the elongated members from the second face through one of the openings in the base slab until the second face of the base slab is engaged by the bifurcated second end, which is too large to pass through the openings.

The elongated members for the drying rack, as described above, have both a stored position and an operative position. In the stored position, the drying rack can be easily carried in the backpack of a person involved in outdoor activities.

The base slab for the drying rack that has been illustrated and will hereinafter be described is rectangular. However, base slab could be made round, oblong or in some other shape and the elongated members would still have a stored position. With a rectangular base slab, it is preferred that there be four elongated members, one for each corner. However, if the base slab were a different shape, there could be as few as three elongated members or more than four.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
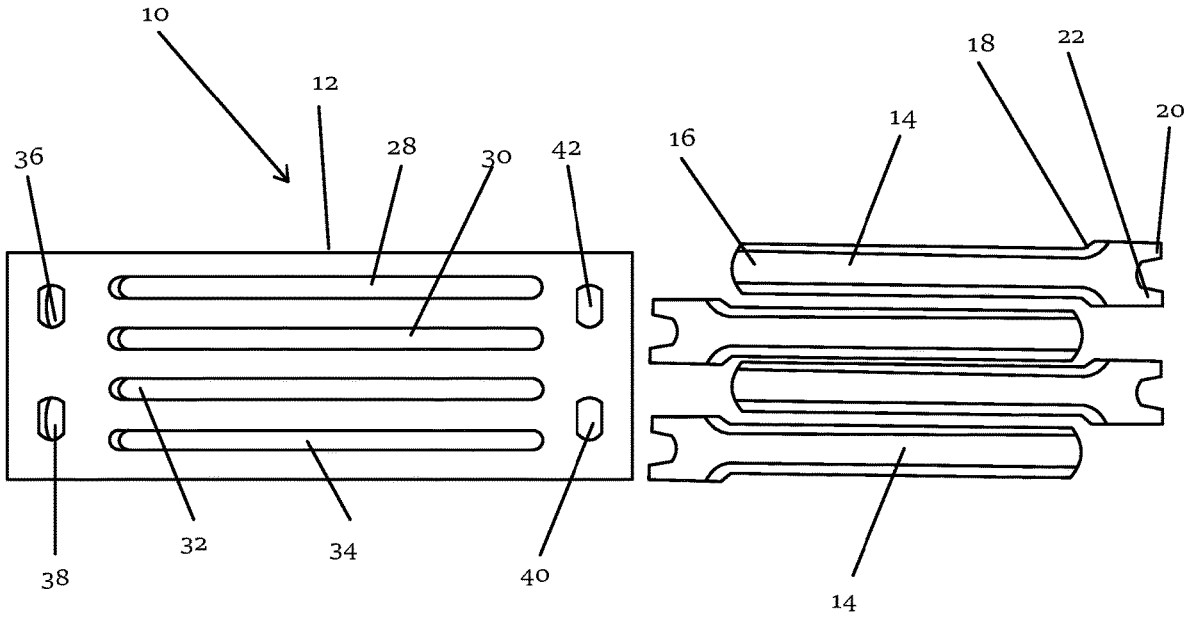
FIG. 1 is a top plan view of components of a drying rack.

A drying rack generally identified by reference numeral 10, will now be described with reference to FIG. 1 through FIG. 5. A variation in how drying rack 10 is assembled and used will then be described with reference to FIG. 6.

Figure 4:
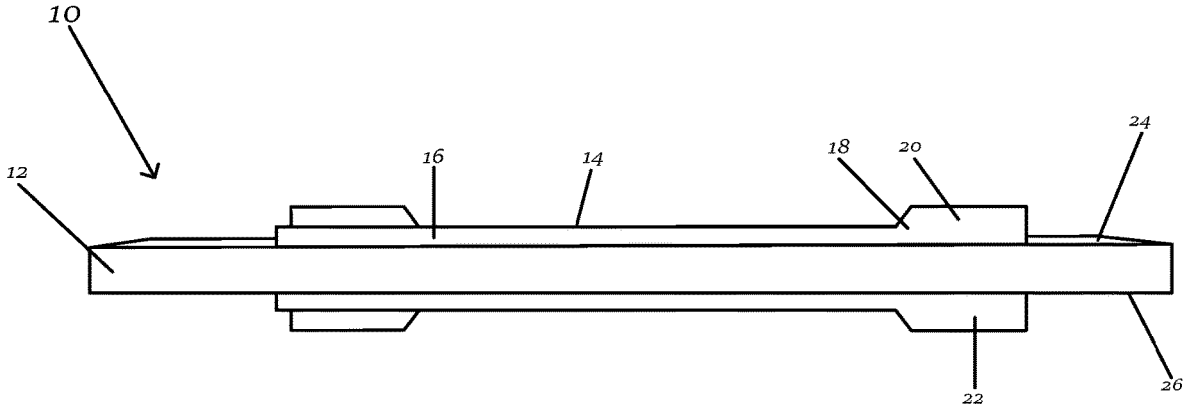
FIG. 4 is a side elevation view of the drying rack of FIG. 3.

Structure and Relationship of Parts:

Referring to FIG. 1, drying rack 10 includes a rectangular base slab 12 and four elongated members 14. Each of the elongated members 14 has a first end 16 and a second end 18. Second end 18 is bifurcated with a first branch 20 and a second branch 22. Referring to FIG. 4, base slab 12 has a first face 24 and a second face 26. Referring to FIG. 1, as base slab 12 is rectangular, it has four corners. There are a series of openings that extend through base slab 12 between first face 24 and second face 26. The series of openings include four slots 28, 30, 32, and 34, a slot for each of the four elongated members 14. The series of openings also include four corner openings 36, 38, 40, and 42. An opening in each of the four corners.

Figure 2:
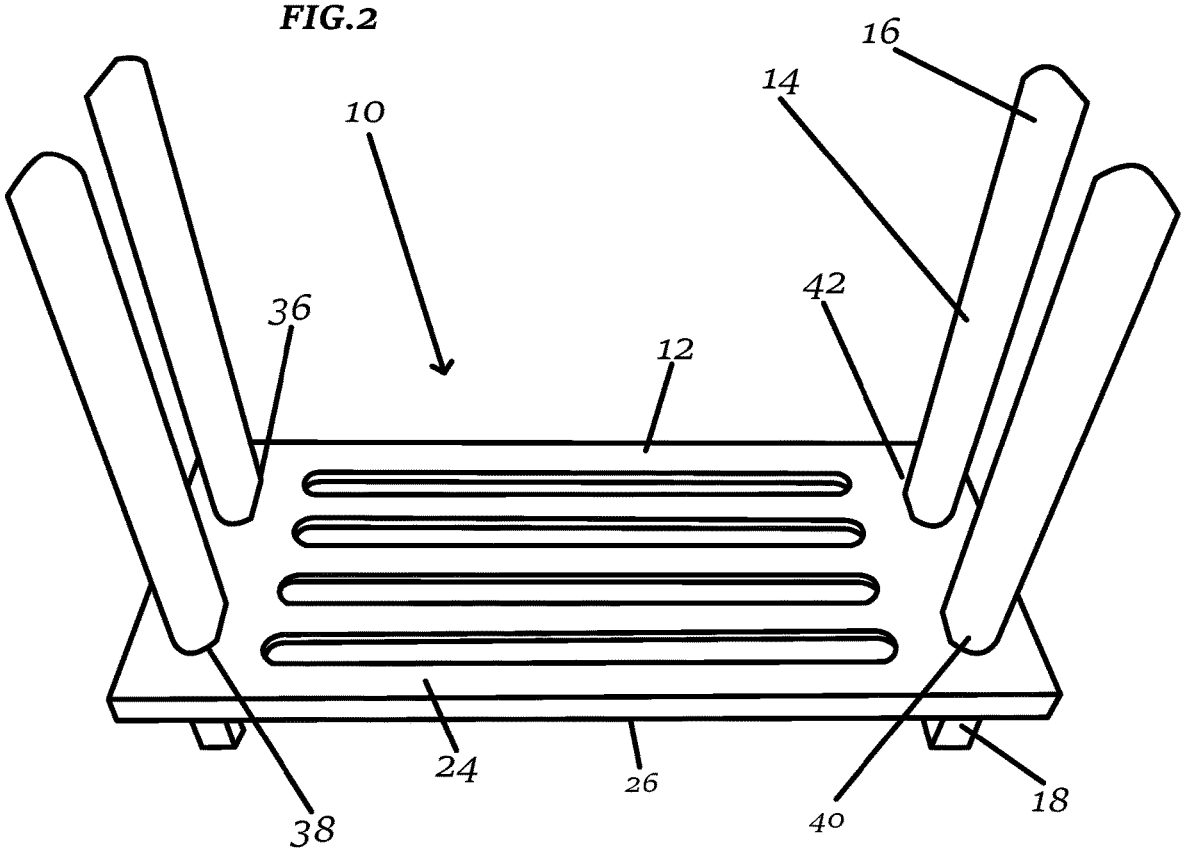
FIG. 2 is a front perspective view of the drying rack of FIG. 1, assembled in an operative configuration ready for use.

Referring to FIG. 2, elongated members 14 have an operative position. In the operative position elongated members 14 are arranged in an upright orientation relative to first face 24 of base slab 12. The first end 16 of each of the four elongated members 14 is inserted from second face 26 through one of corner openings 36, 38, 40, and 42 in base slab 12 until second face 26 of base slab 12 is engaged by bifurcated second end 18 which is too large to pass through corner openings 36, 38, 40 and 42.

Figure 3:
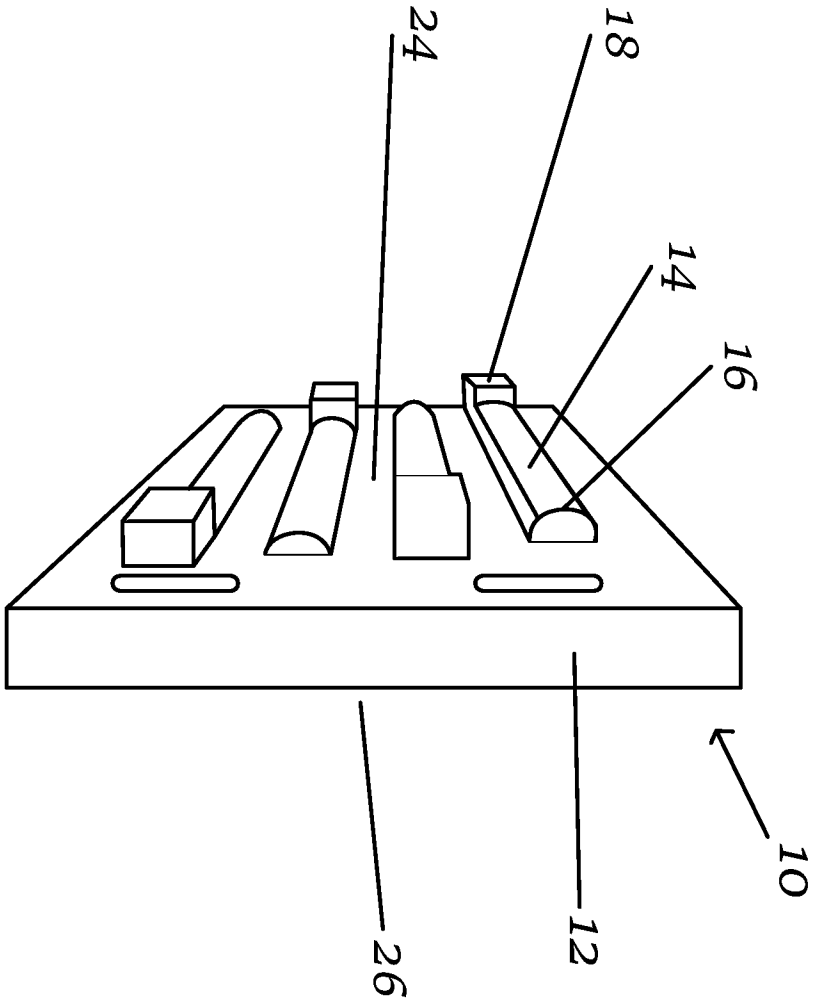
FIG. 3 is an end perspective view of the drying rack of FIG. 1, assembled in a stored configuration ready for transport or storage.

Referring to FIG. 3 and FIG. 4, elongated members 14 have a stored position. In the stored position, second end 18 of each of elongated members 14 is positioned in one of slots 28, 30, 32, and 34 with first branch 20 engaging first face 24 of base slab 12 and second branch 22 engaging second face 26 of base slab 12 and first end 16 of each elongated member 14 being maintained in its respective slot by friction. It will be appreciated that, if desired, friction can be enhanced by various means.

Operation:

Referring to FIGS. 3 and 4, drying rack 10 is normally maintained in the stored position. When a hike, a canoe trip or another outdoor activity is planned, drying rack can be slipped into a backpack.

Figure 5:
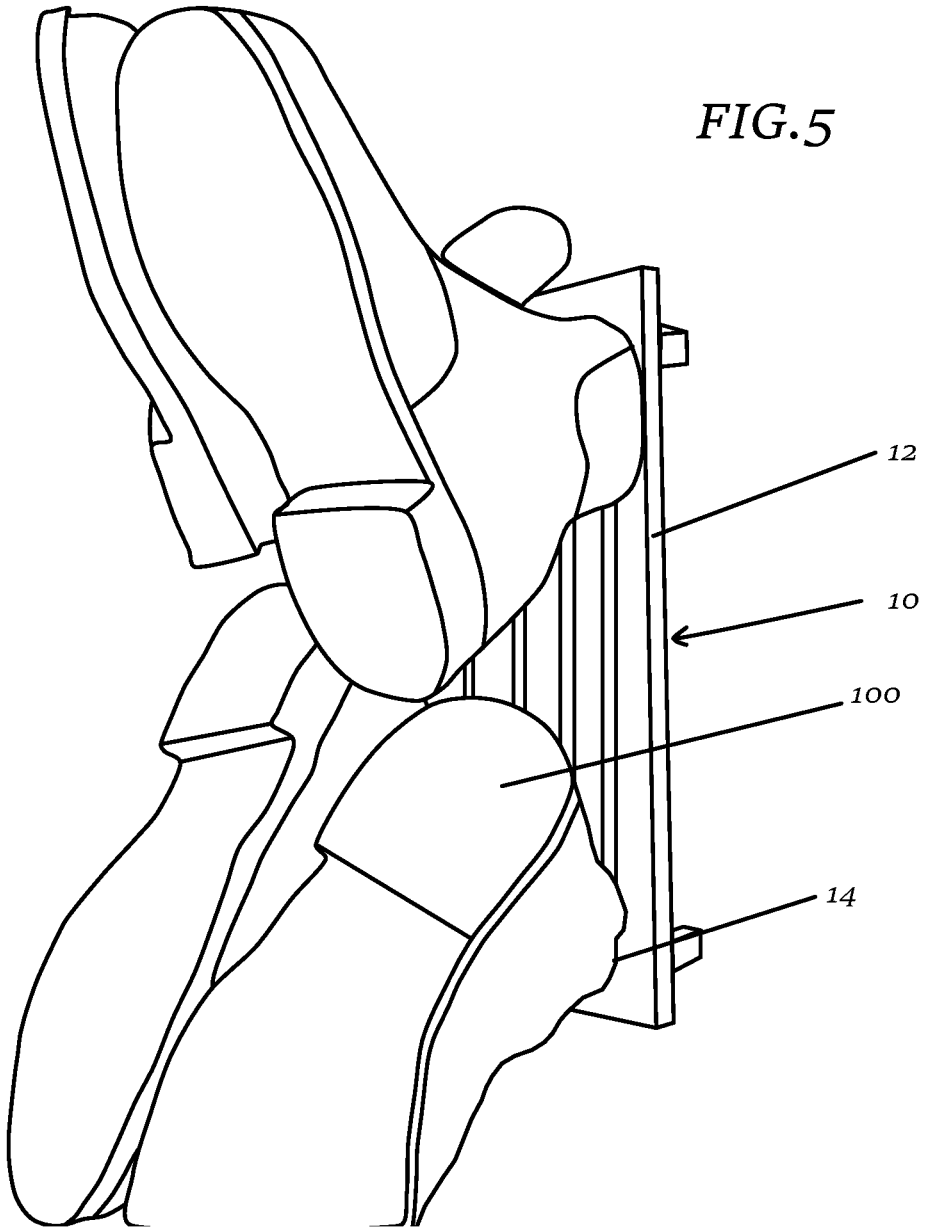
FIG. 5 is a front perspective view of the drying rack of FIG. 2, used drying boots.

Referring to FIG. 2, when drying rack 10 is required to dry wet clothing, first end 16 of each of the four elongated members 14 is inserted from second face 26 through one of corner openings 36, 38, 40, and 42 in base slab 12 until second face 26 of base slab 12 is engaged by bifurcated second end 18 which is too large to pass through corner openings 36, 38, 40 and 42. This places elongated members 14 in the operative position in an upright orientation relative to first face 24 of base slab 12. Referring to FIG. 5, wet articles, such as boots 100, can then be inverted and placed on first end 16 of elongated members 14.

Referring to FIG. 3 and FIG. 4, when it is desired to return elongated members 14 to the stored position, second end 18 of each of elongated members 14 is positioned in one of slots 28, 30, 32, and 34 with first branch 20 engaging first face 24 of base slab 12 and second branch 22 engaging second face 26 of base slab 12 and first end 16 of each elongated member 14 being maintained in its respective slot by friction.

Figure 6:
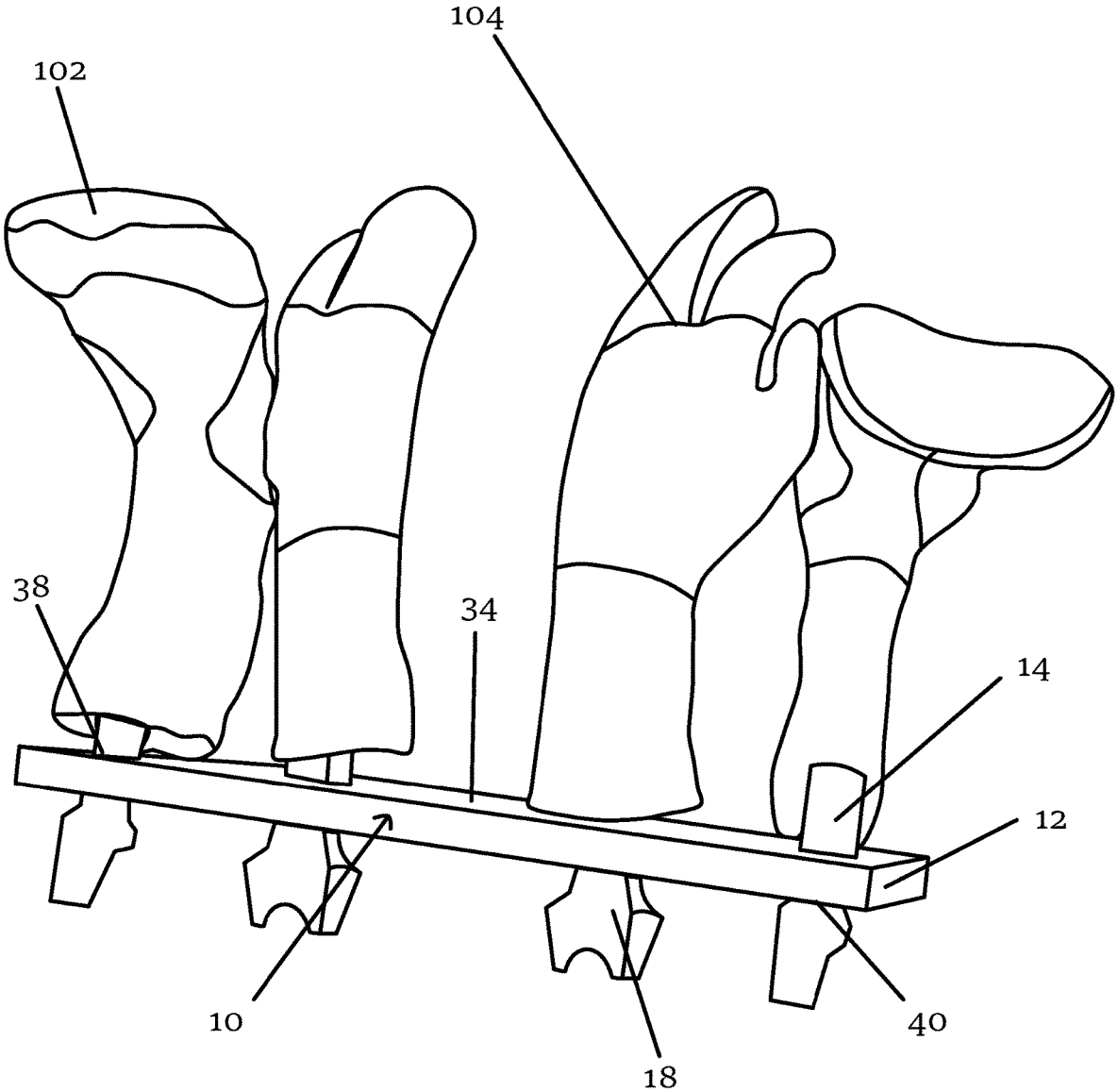
FIG. 6, is a front perspective view of the components of drying rack of FIG. 1, arranged in an alternative configuration and used drying socks and gloves.

Variations:

Referring to FIG. 6, it is to be noted that the four elongated members 14 need not all be inserted into corner openings 36, 38, 40, and 42 in base slab 12. Drying rack can still be used with some of the elongated members 14 positioned in one of slots 28, 30, 32, and 34. As illustrated, two elongated members 14 have been inserted in corner openings 38 and 40, respectively. The other two elongated members have been spaced along slot 34. Socks 102 and gloves 104 are shown inverted and positioned on elongated members 14 for drying.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A drying rack, comprising:

at least three elongated members, each of the elongated members having a first end and a second end, the second end bifurcated with a first branch and a second branch;

a base slab having a first face, a second face and a series of openings that extend through the base slab between the first face and the second face, the series of openings including a slot for each of the elongated members;

the elongated members having a stored position, whereby the second end of each of the elongated members is inserted into a respective slot with the first branch engaging the first face of the base slab and the second branch engaging the second face of the base slab and the first end of each elongated member is maintained in the respective slot by friction; and the elongated members having an operative position, whereby the elongated members arranged in an upright orientation relative to first face of the base slab, whereby the first end of each of the elongated members is inserted from the second face through one of the openings in the base slab whereby the bifurcated second end has a dimension that is larger than a dimension of the respective opening thereby inhibiting the bifurcated second end from passing through the respective opening.

2. The drying rack of claim 1, wherein the base slab is rectangular.

3. The drying rack of claim 2, wherein the base slab has four corners with a corner opening in each of the four corners.

4. The drying rack of claim 3, wherein there are four elongated members.

5. A drying rack, comprising:

four elongated members, each of the elongated members having a first end and a second end, the second end bifurcated with a first branch and a second branch;

a rectangular base slab having a first face, a second face, four corners and a series of openings that extend through the base slab between the first face and the second face, the series of openings including a slot for each of the elongated members and a corner opening in each of the four corners;

the elongated members having a stored position, whereby the second end of each of the elongated members is inserted into a respective slot with the first branch engaging the first face of the base slab and the second branch engaging the second face of the base slab and the first end of each elongated member is maintained in the respective slot by friction; and the elongated members having an operative position, with the elongated members arranged in an upright orientation relative to first face of the base slab, whereby the first end of each of the elongated members is inserted from the second face through one of the openings in the base slab whereby the bifurcated second end has a dimension that is larger than a dimension of the respective opening thereby inhibiting the bifurcated second end from passing through the respective opening.

* * * * *